US008476833B2

(12) United States Patent
Hempelmann et al.

(10) Patent No.: US 8,476,833 B2
(45) Date of Patent: Jul. 2, 2013

(54) METHOD FOR OPERATING A LIGHT-EMITTING DIODE ARRANGEMENT, AND CIRCUIT ARRANGEMENT

(75) Inventors: Frederik Hempelmann, Munich (DE); Ralf Hying, Munich (DE); Bernhard Reiter, Munich (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 363 days.

(21) Appl. No.: 12/986,191

(22) Filed: Jan. 7, 2011

(65) Prior Publication Data

US 2011/0193486 A1 Aug. 11, 2011

(30) Foreign Application Priority Data

Feb. 11, 2010 (DE) ..... 10 2010 001 798

(51) Int. Cl.
*H05B 37/00* (2006.01)

(52) U.S. Cl.
USPC ..... 315/149; 315/159; 315/307; 315/308

(58) Field of Classification Search
USPC ..... 315/307, 308, 291, 149, 156, 159, 315/158, 150, 151, 157
See application file for complete search history.

(56) References Cited

U.S. PATENT DOCUMENTS

| | | | | |
|---|---|---|---|---|
| 7,573,209 | B2 * | 8/2009 | Ashdown et al. | 315/307 |
| 8,207,686 | B2 * | 6/2012 | Sloan | 315/307 |
| 2003/0066945 | A1 | 4/2003 | Muthu et al. | |
| 2007/0097358 | A1 | 5/2007 | Oon et al. | |
| 2009/0206758 | A1 | 8/2009 | Kobilke | |
| 2009/0231354 | A1 | 9/2009 | Blaut et al. | |
| 2009/0302766 | A1 | 12/2009 | Behr et al. | |
| 2010/0264834 | A1 * | 10/2010 | Gaines et al. | 315/152 |

FOREIGN PATENT DOCUMENTS

| | | | |
|---|---|---|---|
| DE | 10239449 | A1 | 8/2003 |
| DE | 102004060890 | A1 | 6/2006 |
| DE | 102005061204 | A1 | 7/2007 |
| WO | 0247438 | A2 | 6/2002 |
| WO | 2007048747 | A1 | 5/2007 |

OTHER PUBLICATIONS

English language abstract of DE 102 39 449 A1, Jan. 21, 2011.

* cited by examiner

*Primary Examiner* — David H Vu

(57) ABSTRACT

A circuit arrangement for operating an LED arrangement, wherein a controller transmits a current intensity value for a respective LED to a driver and the latter feeds the LED with current in a time sequence containing a check pulse, and wherein a measuring device is configured to measure the light emitted by the light-emitting diode on account of the check pulse, wherein the controller is configured to use only measurement values which represent the light of check pulses for the stipulation of current intensity values, and wherein the driver defines a main factor, which is dependent on at least one of the temperature of the LED and on the voltage dropped across said LED, wherein the driver is configured to multiply the current intensity value by the main factor and this product defines the current intensities of all the current pulses in the time sequence apart from the check pulse.

4 Claims, 2 Drawing Sheets

METHOD FOR OPERATING A LIGHT-EMITTING DIODE ARRANGEMENT, AND CIRCUIT ARRANGEMENT

CROSS-REFERENCE TO RELATED APPLICATION

This application claims priority to German Patent Application Serial No. 10 2010 001 798.1, which was filed Feb. 11, 2010, and is incorporated herein by reference in its entirety.

TECHNICAL FIELD

Various embodiments relate to a method for operating a light-emitting diode arrangement. Various embodiments also relate to a circuit arrangement.

BACKGROUND

A light-emitting diode arrangement is understood to mean an arrangement including at least one light-emitting diode unit. A light-emitting diode arrangement typically includes a plurality of light-emitting diode units. Such a light-emitting diode arrangement is, for example, part of a projection device with the aid of which luminous images are generated. The respective light-emitting diode units are supplied with current by means of driver units. In projection devices, a control unit defines a value for the current intensity (current intensity value) for the respective light-emitting diode units. Said value is communicated to the driver unit and implemented by the latter. The implementation usually includes the outputting of current pulses in a time sequence, the current intensity of said current pulses corresponding to the current intensity value communicated by the control unit. The control unit in the projection device has the task, for example, of defining the so-called color locus: if a light-emitting diode arrangement has a plurality of light-emitting diodes that emit in different colors, then the color that arises overall can be defined by means of respective current intensity values for the individual light-emitting diode units. The definition of the color locus and also the definition of the intensity of the emitted light are usually effected in the context of a regulation: there is a photosensitive element in an appropriate measuring unit, which photosensitive element receives and measures the light emitted by a light-emitting diode unit. The measurement values are fed to the control unit, and the latter corrects the current intensity value, if appropriate, that is to say that the current intensity value is stipulated to the driver unit in a manner dependent on at least one measurement value.

WO 02/47438 A2 discloses measuring the temperature of light-emitting diodes and feeding the measurement values to a control unit, which then defines an intensity of the emission in a manner dependent on the temperature.

WO 2007/048747 A1 describes the fact that in a driver unit for light-emitting diodes, numerical values fed to the driver unit can be multiplied, wherein an output signal of the driver unit is defined in a manner dependent on the product thus calculated. This serves, in particular, for putting the brightness proportion factors of the individual light sources in a specific ratio relative to one another. That is necessary during variations of the intensity of the emitted light, the proportion factors, in particular, being variable in this case.

The document DE 10 2005 061 204 describes an illumination system in which 3 colored LEDs and one white LED are controlled independently of one another by a controller.

The document DE 10 2004 060 890 describes a motor vehicle headlight element with LED in which the LED is controlled depending on a measurement variable.

The document DE 102 39 449 describes LED luminaires including a plurality of LEDs, the color or brightness variation of which is compensated for.

The document US 2009/0231354 discloses a calibratable regulation of the color emitted by an LED luminaire.

During the operation of a light-emitting diode it is necessary to prevent the latter from heating up excessively, because permanent damage to the light-emitting diode could occur in this case.

On the other hand, it is a task of the control unit to define the color locus and the intensity of the light emitted by the light-emitting diodes. A monitoring of the light-emitting diodes is not included among the tasks to be assigned to the control unit.

SUMMARY

A method for operating a light-emitting diode arrangement including at least one light-emitting diode, wherein a controller is configured to transmit a current intensity value for a respective light-emitting diode to a driver and the latter is configured to feed the light-emitting diode with current in a time sequence of current pulses in a manner dependent on the current intensity value sent, wherein the time sequence of current pulses contains a check pulse, and wherein the light that is emitted by the light-emitting diode on account of the check pulse is measured by a measuring device with at least one photosensitive element, wherein the measuring device feeds measurement values to the controller, which stipulates the current intensity value in a manner dependent on at least one measurement value, wherein only measurement values that represent the light of check pulses are used for the stipulation of current intensity values, and wherein at least one of the temperature of the respective light-emitting diode and the voltage dropped across said respective light-emitting diode and the temperature of the driver is measured, wherein the driver defines a main factor on the basis of at least one of the measured temperature and voltage, the current intensity value being multiplied by said main factor, wherein the current intensities of all the current pulses in the time sequence apart from the check pulse are defined on the basis of the product thus obtained, and wherein the current intensity of the check pulse is defined directly on the basis of at least one of the current intensity value or on the basis of a further factor that is defined on the basis of the measured temperature and voltage and is different from the main factor.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
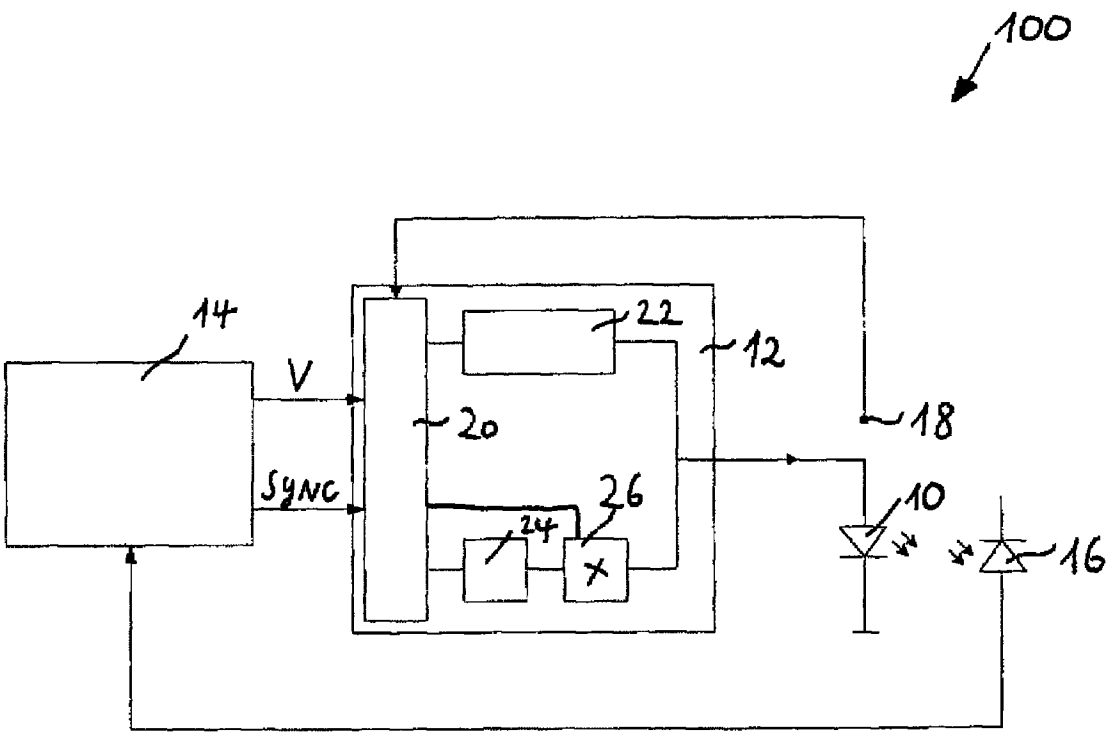
FIG. 1 schematically shows the components of a projection device in which the method according to the invention can be used.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide a method in which the reliable operation of the light-emitting diodes is ensured in a simple and uncomplicated manner. Various embodiments develop for this purpose a circuit arrangement in a suitable manner.

A method according to various embodiments therefore includes measuring the temperature of the respective light-emitting diode unit and/or the voltage dropped across said respective light-emitting diode unit and/or the temperature of the driver unit itself. The driver unit defines a (main) factor on the basis of the measured temperature and/or the measured voltage, the current intensity value being fed by the control unit being multiplied by said factor. The current intensity of all the current pulses in the time sequence, with the exception of the check pulse, is defined on the basis of the product thus obtained. The current intensity of the check pulse, by contrast, is defined directly on the basis of the current intensity value. Alternatively, it can also be multiplied by a factor, but the latter is then different from the main factor.

The current intensity of the check pulse is defined in a conventional manner, for example. Since the measurements by the measuring unit with the at least one photosensitive element are effected on the basis of the check pulse, the regulation by means of the control unit is effected in the conventional manner. The control unit "notices" no difference if the (main) factor as such changes. The reason for this is that the factor only has an influence on those current pulses in the time sequence which do not lead to measurement results of the measuring unit. The introduction of the (main) factor affords the possibility of a correction being effected by the driver unit, particularly if the temperature of the light-emitting diode unit and/or the voltage dropped across the latter leaves the desired range.

In the simplest implementation of the method according to various embodiments, the product of the factor and the current intensity value from the control unit is precisely the current intensity of the current pulses. The factor is then set to be equal to one at customary operating temperatures and operating voltages of the light-emitting diode unit. This means that the driver unit, under customary operating conditions, implements precisely the current intensity value which is stipulated here. By contrast, the factor is set to be less than one if there is an operating temperature or operating voltage that adversely affects the permanent functionality of the light-emitting diode unit or there is a temperature that adversely affects the function of the driver unit. In other words, the current that is fed or applied to the light-emitting diode unit is then reduced. Further heating or permanent damage of the luminous means is thereby avoided. It is accepted that the intensity of the emitted light is reduced in this case. However, since the check pulses still correspond to the stipulated current intensity value, the regulation with the aid of the control unit does not make a corrective intervention; this is because otherwise it would precisely increase the current intensity again when an excessively low intensity is measured. In one alternative, in which the check pulses also do not correspond to the stipulated current intensity value, the further factor for this purpose deviates from one to a lesser extent that the main factor. In that case, although the regulation intervenes, at some time a new equilibrium can arise.

In the case of the circuit arrangement according to various embodiments, the driver unit is designed to output current pulses in a time sequence, of which a check pulse always has a current intensity corresponding to the current intensity stipulation, but all other pulses have a current intensity dependent on the product of the stipulated current intensity and a factor dependent on a measurement variable. In various embodiments, a measuring device for measuring the temperature of at least one light-emitting diode unit or else a measuring unit for measuring the voltage dropped across a light-emitting diode unit is preferably provided in the circuit arrangement.

The provision of the measurement values in the driver unit has the advantage that there is no need for elaborate cabling such as would be necessary if the measurement values were fed to the control unit of a projection device. A temperature sensor, in various embodiments, can easily be provided in the region of the light-emitting diodes and be coupled to the driver circuit; the voltage measurement is easily possible to the same extent. The temperature or voltage measurement can even be performed entirely without additional cabling in the existing driver circuit itself.

A video projection device, which is designated in its entirety by 100 and shown schematically in FIG. 1 includes light-emitting diodes, of which one light-emitting diode 10 is illustrated symbolically. The light-emitting diodes are fed with the light-emitting diode current ILED by a driver circuit 12. The current intensity ILED is defined in a manner dependent on a stipulation V made by a control unit 14 outside the driver 12 and fed to the latter. The stipulation defines the current intensity of individual light-emitting diodes 10 in such a way that the light emitted by the light-emitting diodes has a predetermined color locus. The color locus is therefore determined by the current intensity ILED.

The stipulation V is defined in the context of a regulation; specifically, the control unit 14 regulates to a predetermined color locus or a predetermined intensity of the light emitted by the light-emitting diode 10. The stipulation V may include indications with regard to a multiplicity of pulses. A photodetector 16 measures the light emitted by the light-emitting diode 10 and leads the measurement results to the control unit 14. In order to enable a measurement by the photodetector 16, the driver outputs specific check pulses. Only the light emitted on account of the check pulses determines the regulation.

It may then be the case that the regulation has the effect that a current having an excessively high current intensity flows via the light-emitting diode 10. The latter is then heated and could incur damage. Equally, the voltage dropped across the light-emitting diode 10 or the change in said voltage could also indicate a defect in the light-emitting diode. As illustrated symbolically in FIG. 1, a measuring device 18 measures the temperature T and the voltage U at the light-emitting diode 10. These values are fed to an internal controller 20 in the driver 12.

The internal controller 20 of the driver 12 then distinguishes between the check pulses and the other pulses. As illustrated symbolically by a box 22, the internal controller outputs a current intensity value $I_{desired}$ for the check pulse that is always the same. It likewise outputs a desired current intensity $I_{desired}$ respectively for the other pulses, as illustrated by the box 24. However, in accordance with the box 26, this value $I_{desired}$ is then multiplied by a factor dependent on the measured variables T and U.

Figure 2A:
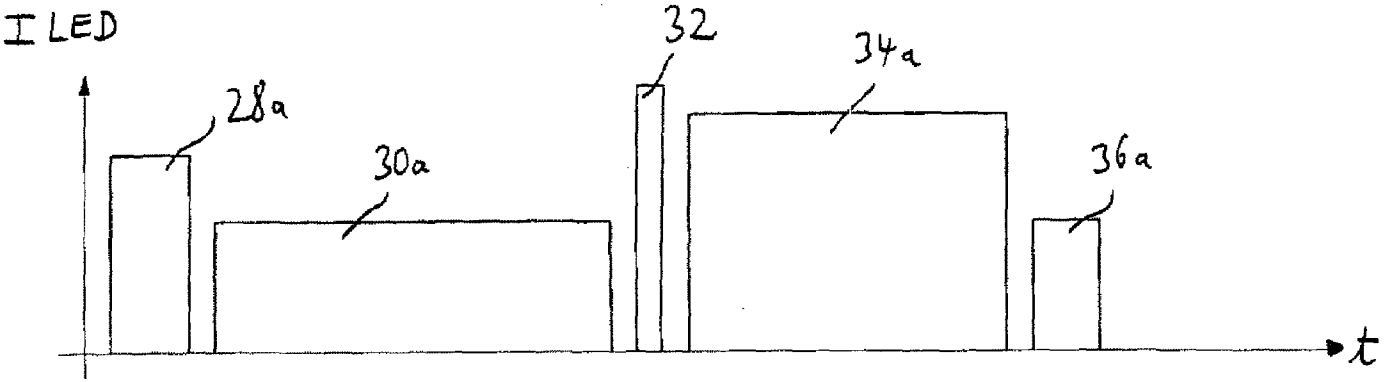
FIG. 2A schematically shows current pulses such as are output when the method according to the invention is carried out under normal operating conditions.

As long as the temperature T and the voltage U assume normal values at which the functionality of the light-emitting diode 10 is ensured, the current pulses output by the driver 12 can appear, for example, in the manner shown in FIG. 2A. The current pulse 28*a* has a first current intensity, the current pulse 30*a* has a second current intensity, a check pulse 32 has a further current intensity, a current pulse 34*a* again has a further current intensity, and a current pulse 36*a* has yet another current intensity.

If, by way of example, the temperature of the light-emitting diode 10 then increases radically, the intention is for the light-emitting diode no longer to have applied to it such a high current intensity as before. Accordingly, a current pulse 28*b* is output instead of the current pulse 28*a*, and a current pulse 30*b* is output instead of the current pulse 30*a*. By contrast, the check pulse 32 remains unchanged. The current pulses 34*a* and 36*a* are changed into the current pulses 34*b* and 36*b*.

Therefore, the current intensity is reduced over the majority of the time. The fact that the check pulse 32 remains the same has to be accepted in this case.

Figure 2B:
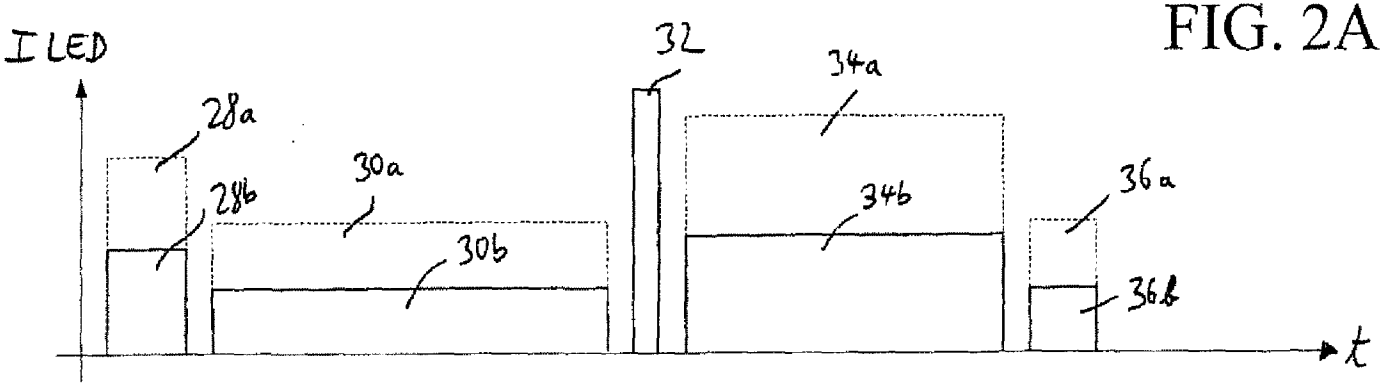
FIG. 2B shows the same type of current pulses such as are output under unusual conditions.

As a result of the reduction of the current intensity in accordance with FIG. 2B in comparison with FIG. 2A, the light-emitting diodes 10 are dimmed. Normally, the control unit 14 would then react by increasing the stipulation V. This is avoided in the present case, however, because the check pulse 32 remains unchanged: since, after all, only the light emitted in the event of said check pulse determines the regulation after its measurement, the reduction of the current intensity by the driver 12 has no influence on the behavior of the control unit 14.

The arrangement according to various embodiments may have the advantage that the control unit 14 is still allocated its actual task of regulation with regard to the color locus or an intensity, while a correction in the event of an excessively increased temperature T or a forward voltage U indicating an LED fault is effected by the driver 12. A measuring unit in the manner of the measuring unit 18 can also be provided in an uncomplicated manner in the region of the driver 12.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A method for operating a light-emitting diode arrangement comprising at least one light-emitting diode, wherein a controller is configured to transmit a current intensity value for a respective light-emitting diode to a driver and the latter is configured to feed the light-emitting diode with current in a time sequence of current pulses in a manner dependent on the current intensity value sent, wherein the time sequence of current pulses contains a check pulse, and wherein the light that is emitted by the light-emitting diode on account of the check pulse is measured by a measuring device with at least one photosensitive element, wherein the measuring device feeds measurement values to the controller, which stipulates the current intensity value in a manner dependent on at least one measurement value, wherein only measurement values that represent the light of check pulses are used for the stipulation of current intensity values, and wherein at least one of the temperature of the respective light-emitting diode and the voltage dropped across said respective light-emitting diode and the temperature of the driver is measured, wherein the driver defines a main factor on the basis of at least one of the measured temperature and voltage, the current intensity value being multiplied by said main factor, wherein the current intensities of all the current pulses in the time sequence apart from the check pulse are defined on the basis of the product thus obtained, and wherein the current intensity of the check pulse is defined directly on the basis of at least one of the current intensity value or on the basis of a further factor that is defined on the basis of the measured temperature and voltage and is different from the main factor.

2. The method as claimed in claim 1, wherein the product of the factor and the current intensity value precisely determines the current intensity of the current pulses, and wherein the main factor is set to be equal to one at customary operating temperatures and operating voltages of the light-emitting diode and the main factor is set to be less than one at an operating temperature or operating voltage which adversely affects the permanent functionality of the light-emitting diode.

3. A circuit arrangement for operating a light-emitting diode arrangement comprising at least one light-emitting diode, wherein a controller is configured to transmit a current intensity value for a respective light-emitting diode to a driver and the latter feeds the light-emitting diode with current in a time sequence of current pulses in a manner dependent on the current intensity value sent, wherein the time sequence of current pulses contains a check pulse, and wherein a measuring device with at least one photosensitive element is configured to measure the light that is emitted by the light-emitting diode on account of the check pulse, wherein the measuring device is configured to feed measurement values to the controller, which stipulates the current intensity value in a manner dependent on at least one measurement value, wherein the controller is configured to use only measurement values which represent the light of check pulses for the stipulation of current intensity values, and wherein the driver defines a main factor, which is dependent on at least one of the temperature of the respective light-emitting diode and on the voltage dropped across said respective light-emitting diode, wherein the driver is configured to multiply the current intensity value by the main factor and this product defines the current intensities of all the current pulses in the time sequence apart from the check pulse, and wherein the driver defines the current intensity of the check pulse directly on the basis of at least one of the current intensity value or on the basis of a further factor that is dependent on the measured temperature and voltage and is different from the main factor.

4. The circuit arrangement as claimed in claim 3, wherein a measuring device is designed to measure at least one of the following:

the temperature of at least one light-emitting diode;

the voltage dropped across a light-emitting diode; and the temperature of the driver.

* * * * *